US005500086A

United States Patent [19]

Sakai et al.

[11] Patent Number: 5,500,086

[45] Date of Patent: Mar. 19, 1996

[54] METHOD FOR PRODUCING PULP FROM GREEN ALGAE

[75] Inventors: Masayasu Sakai; Touru Seto; Masato Kaneko; Michio Hada; Toshiaki Kinomoto, all of Hiroshima, Japan

[73] Assignee: Mitsubishi Jukogyo Kabushiki Kaisha, Tokyo, Japan

[21] Appl. No.: 54,635

[22] Filed: Apr. 30, 1993

Related U.S. Application Data

[63] Continuation of Ser. No. 798,724, Nov. 29, 1991, abandoned.

[30] Foreign Application Priority Data

Nov. 29, 1990 [JP] Japan ..... 2-331797
Nov. 29, 1990 [JP] Japan ..... 2-331801

[51] Int. Cl.[6] ..... D21C 9/153

[52] U.S. Cl. ..... 162/65; 162/99

[58] Field of Search ..... 162/65, 99, 87, 162/76, 90

[56] References Cited

U.S. PATENT DOCUMENTS 1,322,237 11/1919 Frydensberg ..... 162/99
1,367,279 2/1921 Pomorski ..... 162/99
1,509,035 9/1924 Thornley et al. ..... 162/99
1,675,244 6/1928 Blombery ..... 162/99
4,235,043 11/1980 Harasawa et al. ..... 47/1.4

FOREIGN PATENT DOCUMENTS 508671 7/1939 United Kingdom .

OTHER PUBLICATIONS

Rydholm, *Pulping Processes,* Int. Pub., Sep. 1967 pp. 1152 and 1153.
Abstract of Japanese Patent No. 54 038 901.
Allgemeine Botanik, Wilhelm Nultsch, Georg Thieme Verlag 1986, pp. 168 to 173.
Worlds Patent Index, Section Ch, Week 7918, (JP–A–54 038 901), Y. K. Ohsaka, Derwent Publications Ltd., Class D, Mar. 1979.
Patent Abstracts of Japan, vol. 9, No. 287, (JP–A–60 133 846), JiyuuJiyou Seishi KK, Nov. 14, 1985.

*Primary Examiner*—Steven Alvo
*Attorney, Agent, or Firm*—Jacobson, Price, Holman & Stern

[57] ABSTRACT

Method for producing pulp by using an alga containing cellulose in the cell wall and having the long algae body with the ratio of length to width being 10 to 200 as an ingredient by giving no special treatment or by giving a simple bleaching treatment to produce pulp.

8 Claims, No Drawings

METHOD FOR PRODUCING PULP FROM GREEN ALGAE

This is a continuation of application Ser. No. 07/798,724, filed Nov. 29, 1991 which is now abandoned.

FIELD OF THE INVENTION AND RELATED ART STATEMENT

This invention relates to a method of producing pulp to be used as an ingredient for paper and paper wares.

Wood pulp made from needle-leaved trees or broadleaf trees and bast fiber such as paper mulberry, mitsumata, etc. has been conventional as a major pulp ingredient.

In recent years, however, most of pulp has been made from wood pulp from the viewpoint of advantages in manufacturing costs.

Wood pulp is classified into mechanical pulp (GP, TMP) and chemical pulp (SN, NSSCP) according to its method of manufacturing.

However, these two manufacturing methods share the common principle that cellulose and hemicellulose are collected by mechanical or chemical separation and that lignin which is a part of structural body of wood and which occupies 20 to 35% of the constituent of wood for bonding fibrin such as cellulose and hemicellulose and for keeping wood rigid as aggregate body is removed.

On the other hand, from the viewpoints of limitation of resource or manufacturing costs, the straw (of rice, wheat, oat, etc.) and contracted residue of the sugar cane, etc., usually called bagasse, are used as a substitute for wood pulp.

Although the contents of lignin is straw and bagasse are 12 to 14% and 19 to 21%, respectively, and lower than those of wood, yet the pulp is actually manufactured by the same pulping method through conventional removal of lignin as in the case of wood.

Moreover, delignification processes using microorganism, called biopulping for wood, are under research and development; however, it is not yet out of the experimental stage.

Thus, regarding research and development for manufacturing of pulp, it is not too much to say that most of energy is bent on the way of lignin removal.

Also, a production method of cellulose acetate using acetic acid bacteria as a source of pulp containing substantially no lignin has been developed (Japanese Patent Provisional Publication No. 212295/1986 or 61-212295) and applied to such special purposes as radio (speaker) cone paper.

There is also soda alginate as a paper ingredient not containing lignin for special uses; its example has been reported that the alginic acid of polysaccharide extracted from the sea weed, such as the giant kelp (one of the brown algae division), and wood pulp are mixed and made into radio cone paper (*Paper and Pulp Technic Times*, February, 1968, by Yoshio Kobayashi).

There is another non-wood pulp production method in which cellulose and hemicellulose as pulp sources are isolated physically or chemically from the alga body containing substantially no lignin.

In the method, pulp is produced by chemical treatment of the algae including green, red, yellow algae, etc., such as Spirogyra, Chaetophora, Urothrix, Corallina, Triboneme, etc. (Japanese Patent Provisional Publication No. 38901/1979 or 54-38901). There is a method of pulp production using a combination of physical and chemical treatment of angiosperm, such as brazilian waterweed, etc. as well (Japanese Patent Provisional Publication No. 1319/1980 or 55-1319).

Furthermore, there is a method in which, by the bleaching through light irradiation or chemical treatment of Ulothrix, Hydrodictyon, and Tribonema as algae having the long alga body chosen from freshwater algae, such as blue algae, yellow flagellous plant, and chlorophyta, paper sheet can be produced singly or by way of mixing these with other materials for pulp (Japanese Patent Provisional Publication No. 520/1989 or 54-520).

In the conventional pulp production method using wood as material, amounts of pulp to be obtained from wood is 90% by mechanical pulping methods and 50% by chemical pulping methods.

The yield of the mechanical pulp is comparatively high at 90%. However, energy consumed to mechanically shave lignin off wood is reported to be 2400 KWh per ton of pulp and the mechanical method is energy consuming. In the case of mechanical pulp, lignin tends to adhere to pulp and to be left and, therefore, it is not classified to be of high grade, and mechanical pulp has a share of less than 10% in Japan.

On the other hand, the chemical pulp has good quality and because the method has been now improved so that lignin contained in wood can be used as heat source in the process of pulp production, it is ranked as one of methods for pulp production that has achieved excellent unit requirement of energy. However, the problem has been that the yield of pulp is as low as 50%.

The increase of $CO_2$ considered to be a main reason for the warming of the Earth has, been suggested to be closely related to recent increases in the consumption of fossil fuel. Moreover, it is undeniable that lumbering of forest which absorbs $CO_2$ is partially contributory.

The destruction of forests, caused by lumbering of usable wood such as lauan and mahogany lumber in the tropical rain forests in the Southeast Asian countries, such as Thailand, Malaysia, the Philippines, etc. in particular, has attracted international attention as one of the environmental problems.

Furthermore, the domestic production of paper is 27 million tons (in 1989) in Japan and 50% of which has been manufactured using virgin pulp. This means that more than 40 million cubic meters of lumber has been consumed on a yearly basis. From a global viewpoint, the world yearly production of lumber has reached to 3 billion cubic meters, resulting in yearly decrease of 20 million hectares of forest areas out of the present 2.5 billion hectares, and the global increase of demand for wood is 40 to 50 million cubic meters per year. This would pose big problems on a global scale and therefore a switch of materials for pulp to non-wood sources has become an urgent issue to be considered.

In addition, as a measure for switching materials for pulp to non-wood sources, methods using, as materials, angiosperm such as brazilian waterweed and parts of green, blue, red algae and yellow flagellous plant, have been adopted; yet, in these methods, as in the conventional production processes, because the process in which pulp is refined by physical and chemical treatment of the algae (angiosperm and other algae) has been applied, they are energy-consuming with low yields of pulp.

The uses of paper made from cellulose acetate using acetic acid bacteria or soda alginate extracted from brown algae are limited to special fields because the length and width of fibers are extremely short compared with those of conventional fibers, although wood is not starting material.

OBJECT AND SUMMARY OF THE INVENTION

It is an object of the present invention to provide a new solution to the conventional above-mentioned problems.

For this purpose, in the present invention, algae which contain cellulose as a constituent of cell walls and which have a long body with the ratio of body length to body width being 10 to 200 have been used as a pulp ingredient.

When new sources for pulp are searched from the viewpoint that materials should be less energy consuming and economical and high in terms of yield of pulp for prevention of forest destruction on a global scale, new plants have been searched which satisfy the following conditions:

(1) that the content of lignin is substantially zero;

(2) that cellulose is contained in the cell wall constituting the algae body; and (3) that the algae have a long body with a ratio of their body length to their width being 10 to 200, and as a result it has become clear that paper sheets can be produced by using, as ingredients or pulp, algae containing cellulose as a constituent of cell walls such as Closterium and Pleurotaenium.

The reason is that cellulose and hemicellulose are contained in the cell wall of these algae and useful as ingredients for pulp, and furthermore that the contained hemicellulose is effective to facilitate hydrogen bond within the pulp.

As the algae containing cellulose in the cell walls, green algae, and other aquatic plants, e.g., emerging plants, floating leaf plants, submerged plants, and floating plants may be listed.

Out of these algae, Closterium, and Pleurotaenium are particularly useful as ingredients for pulp. The body length of these algae is long and the ratio of the body length and the body width is 10 to 200.

These bodies of algae contain cellulose and much hemicellulose but no lignin, and therefore thin and strong paper sheets with strong bonded structure of pulp can be produced without artificial treatment such as removal of lignin.

Moreover, when these bodies of algae are mixed into the conventional wood pulp, the content of hemicellulose is increased so as to make it possible to produce paper with strongly bonded structure of pulp.

The present invention also provides the algae, having long bodies with the ratio of their length to their width being 10 to 200, which can be used as an ingredient for pulp for paper production, and can prevent the increase of energy consumed and the lowering of yield of pulp which have been disadvantages in the conventional methods. Also, these algae can be used as they are, without any artificial treatment.

However, while the above-mentioned algae having long bodies with the ratio of their body length to width being 10 to 200 and containing cellulose in the cell wall can be used as they are, without special complicated processes, paper sheets produced by using the pulp made from the algae are comparatively of low grade.

The inventors have found after further study that high quality pulp can be obtained by simple bleaching treatment of the algae of Closterium genus. Closterium is one of the genera of unicellular conjugate algae, the body of which is thin and long with the length of 0.1 mm to 1 mm or so and both ends of which are cuspidate, and the general shape is lunate and curved. It is widely distributed in the pond, marsh, paddy field, etc., and can be easily gathered and cultured.

Thus, in the present invention, out of the algae containing cellulose in the cell wall, the algae in the genus of Closterium have been chosen as an ingredient and bleached chemically using chlorine, ozone, etc. to manufacture pulp.

In addition, in the present invention, besides the above bleaching treatment, a chemical treatment using acid and alkali is provided.

By using the algae of the genus of Closterium as an ingredient and by bleaching chemically using ozone, chlorine, etc., pulp can be turned into paper of good quality. The pulp thus obtained can be a substitute for wood pulp. Furthermore, this pulp production method requires no cooking process to remove lignin and therefore malodorous substances are not emitted, offering advantages not only in that the process does not generate environmental pollution but also in that the process itself is simple.

DETAILED DESCRIPTION OF PREFERRED EMBODIMENTS

The detailed embodiments in the present invention are provided below.

The present invention provides a method for producing pulp in which by using as an ingredient algae containing no lignin which is a main factor for high energy consumption and for lowering the yield of pulp, and containing cellulose in their cell walls, the consumption of energy to remove lignin and the pulp loss are made substantially zero. Here, the algae containing cellulose in their cell walls and having a long body with the ratio of length to width being 10 to 200 are chosen.

The examples of the algae include *Closterium gracile, Closterium aciculare var, subpronum, Closterium kuetzingii, Closterium setaceum, Closterium lineatum, Closterium striolatum* of Closterium genus in the division of green algae, *Pleurotaenium repandum* of Pleurotaenium genus, etc.

However, the algae to be used here are not limited to the above, and any algae can be applied if they can be used without any artificial treatment and have the ratio of the body length to the body width being within a range of 10 to 200.

The above-mentioned algae, in the cell walls of which cellulose and hemicellulose are contained, can be used to make paper directly, or by mixing with other wood pulp to manufacture paper sheets.

The following is more detailed description of the embodiments of the present invention.

Embodiment 1

*Closterium aciculare var, subpronum* of Closterium genus was put in the culture solution of $Ca(NO_3)_2 \cdot 4H_2O$ 2 g/l, $KNO_3$ 10 g/l, $NH_4NO_3$ 5 g/l, β-$Na_2$ glycerophosphate 3 g/l, $MgSO_4 \cdot 7H_2O$ 2 g/l, Vitamin $B_{12}$ 0.01 mg/l, Biotin 0.01 mg/l, Thianuire HCl 1 mg/l, $FeCl_3 \cdot 6H_2O$ 19.6 μg/l, $MnCl_2 \cdot 4H_2O$ 3.6 μg/l, $ZnSO_4 \cdot 7H_2O$ 2.2 μg/l, $CoCl_2 \cdot 6H_2O$ 0.4 μg/l, $Na_2MoO_4 \cdot 2H_2O$ 0.25 μg/l, $Na_2EDTA \cdot 2H_2O$ 166 μl/l, $Fe(NH_4)_2(SO_4)_2 \cdot 6H_2O$ 75 μg/l, and HEPES 40 g/l, and the pH was adjusted to 7.2.

The algae were cultured in the medium at a temperature of 25° C., under the illuminance of 7,000 lux with ventilation of air containing carbon dioxide at 0.5% and under a condition of 12 hours bright and dark cycle. Then, 500 g of the algae were taken out in a wet state from the culture solution and, in accordance with JIS-P-8209, hand-made paper was produced with a standard of weighing 60g/m$^2$.

The results are as follows:

| | |
|---|---|
| Weight (g/cm$^2$) | 62.0 |
| Bulk density (g/cm$^3$) | 0.53 |
| Bursting strength (kg/CM$^2$) | 0.85 |
| Elongation (km) | 2.3 |

Embodiment 2

*Pleurotaenium ehrenbergii var, ehrenbergii* of Pleurotaenium genus was cultured in the culture medium of $Ca(NO_3)_2 \cdot 4H_2O$ 2 g/l, $KNO_3$ 10 g/l, β-$Na_2$ glycerophosphate 3 g/l, $MgSO_4 \cdot 7H_2O$ 2 g/l, Vitamin $B_{12}$ 0.01 mg/l, Biotin 0.01 mg/l, Thianuire HCl 1 mg/l, $FeCl_3 \cdot 6H_2O$ 19.6 μg/l, $MnCl_2 \cdot 4H_2O$ 3.6 μg/l, $ZnSO_4 \cdot 7H_2O$ 2.2 μg/l, $CoCl_2 \cdot 6H_2O$ 0.4 μg/l, $Na_2MoO_4 \cdot 2\ H_2O$ 0.25 μg/l, $Na_2EDTA$ 100 μl/l, $Fe(NH_4)_2(SO_4)_2 \cdot 6H_2O$ 75 μg/l, and HEPES 40 g/l under the same condition as in the above embodiment 1, and 300 g of the alga was taken out in a state of wetting.

Then, 30 g of broadleaf tree pulp as weighed in a dry state was mixed with the above cultured algae, and handmade paper was produced under the same condition as in the above embodiment 1.

The results are as shown below.

| | |
|---|---|
| Weight (g/cm$^2$) | 55.7 |
| Bulk density (g/cm$^3$) | 0.81 |
| Bursting strength (kg/CM$^2$) | 1.36 |
| Elongation (km) | 4.9 |

As shown in the above two embodiments, it has been proved that paper sheets can be made from the algae containing cellulose in the cell walls and having long bodies with the ratio of length of the body to their width being 10 to 200.

Next, another embodiment is shown in detail for a method in which pulp is produced using algae of Closterium genus as an ingredient to which chemical bleaching by ozone, chloride, etc. are given and, in addition to the above-mentioned bleaching, chemical treatment by acid and alkali is added.

Embodiment 3

Seven kinds of algae out of Closterium genus was chosen, as shown in Table 1, and culture experiment thereof was executed using a batch-type culture tank (21 of culture medium).

The culture solution of $NH_4NO_3$ 1.0 g/l, $K_2HPO_3$ 0.1 g/l, $Fe_2\ SO_4 \cdot 7H_2O$ 0.005 g/l, $MgSO_4 \cdot 7H_2O$ 0.01 g/l was used as culture medium. The wetting body of the algae (1 g based on scapus) was put on 2 liters of the culture medium. An alga was cultured for 100 hours at pH 7.0, at a temperature of 20° C. and under illuminance of 3,000 lux, and with ventilation of air containing 5% of carbon dioxide from the base part of the culture tank. Thus, this batch-type culture was in turn given to each of the seven kinds of the algae.

Table 1 shows the yield, shape and dimensions of these seven algae.

TABLE 1

Test results of batch-type culture

| No. | Species | Collected quantity (g as dried) | Body Shape: length (mm) | Body Shape: length/width (ratio at the center of the body) |
|---|---|---|---|---|
| 1 | Closterium acerosum | 8.1 | 0.35 | 14 |
| 2 | Closterium ehrenbergil | 10.5 | 0.50 | 15 |
| 3 | Closterium moniliferum | 7.6 | 0.30 | 10 |
| 4 | Closterium Gracile | 11.0 | 0.20 | 40 |
| 5 | Closterium calosporum | 12.5 | 0.15 | 15 |
| 6 | Closterium aciculare | 13.0 | 0.60 | 100 |
| 7 | Closterium incurvum | 11.0 | 0.08 | 12 |

It has been found from the experiment results that No.6 is the only alga to satisfy the conditions on the length; i.e., the length is 0.5 mm or longer and the length to width ratio is about 100.

Also, judging from only apparent configuration of the algae, it is true that No.6 is the best; however, because life support substances mainly consisting of water and chlorophyll are contained in the internal body of the algae and because it has been observed that, after the internal constituent is taken out by bleaching treatments or the like, the width of the alga body is reduced to one fifth or one tenth even if the alga has a wide body, No.2 alga is also usable and, furthermore, if the algae are grown up more by improving culturing methods, No.1 and No.3 algae can be used as well.

Embodiment 4

Five grams (as dried) of the No.2 alga collected in the Embodiment 3 was taken and soaked in water at normal temperature into which ozonized air containing 1 vol % of ozone was ventilated. The algae died after the ventilation of the ozonized air containing ozone for about five minutes and turned white.

Microscopic observation of the dead algae showed that the central wall of the body was partially destroyed, and most of internal substances flowed out of the body, and chlorophyll was also bleached completely.

Due to the above-mentioned flowing of the internal substances out of the body, it was observed that the width of the body was reduced and became contracted to approximately one fifth and became thin and long although the degree of contraction varied depending upon its area and direction.

An amount of 4.1 g (as dried) of the alga body was collected by washing in water and drying. It became clear that the wall region, considered to be connecting portions of cells, in the central portion of the body of lunate algae could be partially and collectively broken by adding comparatively small amounts of ozone having strong oxidation power to break cell walls.

By using ozone, recovery of nutrient contained in the internal substance and bleaching of chlorophyll could be made. Therefore, this ozone treatment is shown to be effective.

Embodiment 5

Five grams (as dried) of No.6 alga collected in the above-mentioned embodiment 3 was taken out and soaked into 200 ml water at normal temperature and then bleached for 30 minutes using 1 g of sodium hypochlorite and 1 ml of concentrated sulfuric acid, and washed and dried to produce 4.4 g (as dried) of the algae body.

Embodiment 6

Five grams (as dried) of the alga body was obtained by the same procedures as in the above-mentioned embodiment 5. This alga was soaked in 200 ml of water, and 20 ml of 5% NaOH was added to it. After boiling for several minutes the alga was washed in water and filtered to produce 4.6 g of dried alga body.

Through the alkali treatment, the weight of the dried alga body was reduced by 0.4 g, and this is due to the refining of pulp (cellulose).

Embodiment 7

Using the bleached and refined alga body of the lunate algae obtained in the above-mentioned embodiments 4, 5 and 6, hand-made paper sheet was produced following JIS-P-8209, and a test on paper quality was executed according to JIS specifications.

Table 2 shows the results of the test.

The paper made in this invention stands comparison in quality with paper made from the kraft wood pulp or chemical wood pulp. Furthermore, the surface of the paper sheet manufactured here was free from excessive smoothness that tended to exist in the products from other algae, and was usable as a substitute for conventional pulp.

TABLE 2

| Test items | Embodiment 4 | Embodiment 5 | Embodiment 6 |
|---|---|---|---|
| Weight ($g/m^2$) | 41 | 45 | 43 |
| Bulk density ($g/cm^3$) | 0.45 | 0.48 | 0.46 |
| Bursting strength ($kg/cm^2$) | 1.30 | 1.50 | 1.80 |
| Bursting length (km) | 4.5 | 4.7 | 5.0 |
| Folding endurance (times) | 40 | 42 | 45 |
| Brightness (%) | 72 | 70 | 75 |
| Opacity (%) | 80 | 82 | 82 |

We claim:

1. A method of making a non-wood source of paper making pulp comprising the steps of:

(a) culturing a green alga from Closterium genus; said culture containing assimilable sources of carbon, nitrogen and inorganic substances;

(b) harvesting the alga from the culture;

(c) washing the alga with water; and (d) drying the alga; and (e) bleaching the alga to partially destroy the central wall of the body of the alga, to remove most of the internal substances from the body and to completely bleach the chlorophyll to form a paper pulp in the absence of a lignin removal process and a chemical treatment process;

said green alga containing cellulose as a component of a cell wall, containing substantially no lignin and having a long body, whose ratio of body length to body width is 10 to 200; using said pulp to form paper in a paper making process.

2. The method according to claim 1, wherein the Closterium species is selected from a group consisting of *Closterium gracile, Closterium aciculare var. subpronum, Closterium kuetzingii, Closterium sataceum, Closterium lineatum, Closterium striolatum.*

3. A method of making a non-wood source of paper making pulp comprising the steps of:

(a) culturing a green alga from Plurotaenium genus; said culture containing assimilable sources of carbon, nitrogen and inorganic substances;

(b) harvesting the alga from the culture;

(c) washing the alga with water; and (d) drying the alga; and (e) bleaching the alga to partially destroy the central wall of the body of the alga, to remove most of the internal substances from the body and to completely bleach the chlorophyll to form a paper pulp in the absence of a lignin removal process and a chemical treatment process;

said green alga containing cellulose as a component of a cell wall, containing substantially no lignin and having a long body, whose ratio of body length to body width is 10 to 200; using said pulp to form paper in a paper making process.

4. The method according to claim 3, wherein Pleurotaenium species is *Pleurotaenium ehrenbergii, var. ehrenbergii.*

5. A method of making a non-wood source of paper making pulp comprising the steps of:

(a) culturing a green alga from Closterium genus; culture containing assimilable sources of carbon, nitrogen and inorganic substances;

(b) harvesting the alga from the culture;

(c) washing the alga with water; and (d) drying the alga; and (e) bleaching the alga with ozone to partially destroy the central wall of the body of the alga, to remove most of the internal substances from the body and to completely bleach the chlorophyll to form a paper pulp in the absence of a lignin removal process and a chemical treatment process;

said green alga containing cellulose as a component of a cell wall, containing substantially no lignin and having a long body, whose ratio of body length to body width is 10 to 200; using said pulp to form paper in a paper making process.

6. The method according to claim 5, wherein the Closterium species is selected from a group consisting of *Closterium gracile, Closterium aciculare vat. subpronum, Closterium kuetzingii, Closterium sataceum, Closterium lineatum, Closterium striolatum.*

7. A method of making a non-wood source of paper making pulp comprising the steps of:

(a) culturing a green alga from Plurotaenium genus; said culture containing assimilable sources of carbon, nitrogen and inorganic substances;

(b) harvesting the alga from the culture;

(c) washing the alga with water; and (d) drying the alga; and (e) bleaching the alga with ozone to partially destroy the central wall of the body of the alga, to remove most of the internal substances from the body and to completely bleach the chlorophyll to form a paper in the absence of a lignin removal process, and a chemical treatment process;

said green alga containing cellulose as a component of a cell wall, containing substantially no lignin and having a long body, whose ratio of body length to body width is 10 to 200; using said pulp to form paper in a paper making process.

8. The method according to claim 7 wherein Pleurotaenium species is *Pleurotaenium ehrenbergii, var. ehrenbergii.*

* * * * *